US007360763B2

(12) United States Patent
Wong

(10) Patent No.: US 7,360,763 B2
(45) Date of Patent: Apr. 22, 2008

(54) YANGTZE HOLD 'EM AND OTHER POKER GAMES PLAYED WITH A CHINESE POKER DECK

(75) Inventor: Jacob Y. Wong, Goleta, CA (US)

(73) Assignee: Gamelot, Inc., Goleta, CA (US)

( * ) Notice: Subject to any disclaimer, the term of this patent is extended or adjusted under 35 U.S.C. 154(b) by 0 days.

(21) Appl. No.: 11/479,554

(22) Filed: Jun. 29, 2006

(65) Prior Publication Data

US 2007/0018403 A1 Jan. 25, 2007

Related U.S. Application Data

(63) Continuation-in-part of application No. 11/058,471, filed on Feb. 14, 2005.

(51) Int. Cl.
*A63F 1/00* (2006.01)

(52) U.S. Cl. ..... 273/274; 273/292

(58) Field of Classification Search ..... 273/274, 273/292

See application file for complete search history.

(56) References Cited

U.S. PATENT DOCUMENTS 4,480,840 A * 11/1984 Chang ..... 273/292
4,836,553 A * 6/1989 Suttle et al. ..... 273/292
5,390,934 A * 2/1995 Grassa ..... 273/292
5,522,594 A * 6/1996 Taylor et al. ..... 473/131
6,688,598 B1 * 2/2004 Hsi ..... 273/292

* cited by examiner

*Primary Examiner*—William M. Pierce
(74) *Attorney, Agent, or Firm*—Wagner, Anderson & Bright, L.L.P.; Roy L. Anderson

(57) ABSTRACT

Games (such as any poker game, whether it be draw poker, stud poker or a community card poker and, more particularly, a Texas hold 'em game or a variant in which players are either initially dealt four cards or the seventh card is dealt face down to individual players) normally played with a traditional deck of cards in accordance with a preselected set of rules for the game are played with a Chinese poker deck of 52 cards and the following additional rules: any player with the right to use a first wild card may designate the first card to be any card contained in the Chinese poker deck but no player may use more than one wild card and any player who can not make a hand because the player has more than one wild card looses the hand to any player who can make a hand. The Chinese poker deck has three different sets of nine cards in three suits (e.g., circles, bamboo and script), each of the nine cards in one of the three suits bearing a different designation representing the numbers 1 through 9, five different sets of four cards bearing a unique designation with a hierarchal ranking (e.g., GD, EW, SW, WW and NW, in descending order of ranking, all of which are higher than a 9 for a single card), and a set of five wild cards (e.g, bearing a unique Feng Shui designation).

16 Claims, 3 Drawing Sheets

YANGTZE HOLD 'EM AND OTHER POKER GAMES PLAYED WITH A CHINESE POKER DECK

CROSS-REFERENCE TO RELATED APPLICATIONS

The present application is a continuation-in part of U.S. application Ser. No. 11/058,471 filed Feb. 14, 2005, entitled "CHINESE POKER DECK," the disclosure of which is specifically incorporated herein by reference.

FIELD OF THE INVENTION

The present invention is in the field of poker games.

BACKGROUND

The casino gaming industry continually seeks to invent new gambling games in order to add flare to the old standbys such as Blackjack, Craps, Poker, Baccarat etc. The object is to keep the gaming interest of both the old and the new customers high in order to maintain and grow the revenues and profits for the industry. In actuality, the so-called new games surfaced in recent years are rarely new but are takeoffs from older games. For example, Caribbean Stud is based on Stud Poker. So are Let It Ride and Three Card Poker. Notwithstanding, new games are still in great demand whether or not they are really new or are just takeoffs from the older standbys.

As we, the "earth people" living in this planet, enter into the 21$^{st}$ century, there have been profound changes in world affairs that severely impact the well-being of our society. One can list a number of such events that led to those changes. But among them three really stand out. The first event has to be the end of the cold war between the Soviet Union and the United States which led indirectly to the breakup of the Soviet Empire. This event has changed many lives, both within and without the former Soviet Union. Many people living formerly under the Soviet rule are today enjoying their political freedom for the first time after many decades. More importantly they have now become productive and free citizens once again in their new environments leading to significant economical gain because of their entrepreneurship and hard work.

The second event has to be the advent of the Internet starting as early as in the late 1970s. Although it took more than two decades including the notorious "WWW or World Wide Wait" period instead of "World Wide Web" for its ridiculously slow services in the beginning, and a gigantic bubble burst in the capital investment community shortly after the turn of the last century to prove to everybody that it is indeed one of the most important events that has taken place. Indeed the Internet, together with the tremendous advances in the silicon chip and the computer software technologies during the past two decades have literally ushered the world into the so-called Information Age. Today virtually everything in private and public commerce is done on the Internet leading to an unprecedented productivity gain in many sectors of industry. It is primarily a direct result of the dawning of this Information Age discussed above that has led to the third event as elucidated below.

The third event could broadly be described as globalization, meaning simply that all activities involving international commerce, trade, finance, communication and production of goods and services are taking place irrespective of continental, national or geographical boundaries as long as they are done in the most efficient and cost-effective manner. The direct consequence of globalization is that goods and services are much cheaper than before because of the immense gain in overall productivity. In other words, countries that possess plenty of cheap labor will automatically be given the opportunity to produce goods or to perform services that are needed worldwide. This globalization has led to a significance rise in the standard of living for almost all countries during the past decade, especially those in the third world. However, globalization is a two-edged sword. Whereas some countries like China and India, whose economies have been benefited tremendously by the effects of globalization, other countries like the US, European Union countries and even Japan have suffered significant negative effects like the loss of employment and the closing down of many factories that are no longer competitive in the world scene. Globalization is today an on-going process and nobody knows for sure what will eventually become of our world. One thing, however, is amply clear. China is presently experiencing a strong rise in its economical fortune.

During the past two decades, as more and more affluent Chinese and Asian gamblers, a direct result of globalization discussed above, came to Las Vegas and Atlantic City to play, there has been a growing sense of opportunity for the casinos to come up with new games in order to attract the attention of these new customers. Common sense will have it that if these new games could be devised based upon the cultural folklores and ancient concepts that the Chinese and Asian revere, such as Yin Yang (two opposing forces) and Feng Shui (wind and water), the chance of these new games being enthusiastically accepted by the new corners will be greatly enhanced. Furthermore, if these new games could blend the old and popular Chinese gambling games such as Mahjongg, Tin Gau, Sic Bo and Fan Tan (the so-called "Big Four"), with the traditional Western style gambling games such as Roulette, Poker, Blackjack etc., the so-called gaming fusion of the East and West, then the chance of success should even be greater.

While the need to create new games for casinos in the U.S., based upon the fusion of the culture and gambling methods of both the East and the West, is pretty much a no-brainer, its realization might not be as simple as one is led to believe. However, it can clearly be done if innovation and prudence are brought to bear in reaching this goal. It is quite apparent that the single most important gambling tool or instrument that anchors many of the traditional Western gambling games is the international 52-card pack. The many versions of the poker games such as Texas Hold'em, 5-Card Stud, 7-Card Stud (Hi/Lo), Draw Poker etc. and many of the so-called new games such as "Spanish 21", "Caribbean Stud", "three Card Poker" etc. all use the international 52-card pack to play the games. In addition to the poker game, the vastly popular Blackjack and the new game of "Let It Ride" also uses the international 52-card pack to play them. Finally, the important game of Baccarat, the favorite of the high rollers, also uses the international 52-card pack to play the game. Apart from the international 52-card pack, the wheel and the small ball used in the playing of Roulette and the two dices used in the playing of Craps are dedicated to their respective specific games and are therefore different both in function and applicability to the international 52 -card pack.

It is well known that over centuries the Chinese love to play the games of chance or to put it simply, they love to gamble. Gambling is literally in their blood, so to say, just as the Irish love visiting their neighborhood pub for a drink of beer after work prior to going home. As mentioned earlier, the traditional gambling games in the East for the Chinese are the so-called "Big Four", namely Mahjongg, Tin Gau, Sic Bo and Fan Tan. Both the Mahjongg and the Tin Gau games have their special set of tiles dedicated to playing the game and they are therefore unique. One uses three dice to play the Sic Bo game and just a big pile of beans or pebbles and a "pick" to play the Fan Tan game. What is conspicuously missing in the East is the counterpart of the West's 52-card pack which anchors many favorite Western gambling games. As alluded to earlier, in order to fully grasp the marketing opportunity that more and more affluent Chinese and Asians will be visiting Las Vegas and Atlantic city in the coming years, casino operators are keen to score one or more "winner" games for the visitors. The current inventor recognizes this unique opportunity and captures it by devising a novel Chinese style poker deck called the "Chinese Poker Deck" whose construct reflects not only its Western origin, but also allows the permeation of the culture and thinking of the East into same through the use of one of the "Big Four" gambling games, namely, Mahjongg.

It is clear from the discussion above that a Chinese Poker Deck has to be invented, or created from scratch, but based upon the Eastern cultural thinking and concept of the original Western 52-card pack in order to take full advantage of the affluent Chinese and Asian gamblers visiting Las Vegas and Atlantic City in the coming years. It is without argument that Mahjongg is by far the most popular gambling game in China and the Far East for at least several hundred years. Thus it is prudent that a portion of the unique tiles of the Mahjongg set is used as a basis for forming the Chinese Poker Deck. Because of the fact that most Chinese and Asians are already quite familiar with and knowledgeable in playing Mahjongg, they naturally would be able to recognize the various special tiles of the game without much difficulty. As a matter of fact, most Chinese have already known for years the entire set of Mahjongg tiles by heart since their adulthood. During the early '50s, there were Mahjongg parlors in most major casinos in Las Vegas to accommodate small numbers of gamblers from China and the Far East. But due to the small operating profits obtained by casinos from these Mahjongg parlors, most of them started to disappear from the Las Vegas gambling scene in the early '70s. By the early '80s in Las Vegas, Mahjongg parlors became nothing but a fond memory of the past. Still, Mahjongg continues to be the number one family gambling game in Asia, particular in China. Although officially no gambling is allowed within the People's Republic of China, because people love to play this game so much that the playing of Mahjongg has been tacitly allowed since the communists took over China back in 1949 and such is still prevailing today.

It is difficult to imagine a Chinese who is indifferent to Feng Shui—the age old Chinese concept of associating harmony with luck and good fortune! Feng Shui in Chinese means wind and water. Its origin dates back several thousand years to ancient China. The geography of that vast land requires careful consideration when constructing a building since the mountain winds can be severe and the lower areas are prone to flooding. Thus for the ancient Chinese, Feng Shui literally means "luck engineering". However, the ancient Chinese did not consider luck as synonymous with chance. To them luck was opportunity and they believed that even if presented with opportunity, many of us do not act and grasp it with both hands. Today Feng Shui remains as both a fascinating and a revered living concept for the Chinese. They not only believe in Feng Shui, but also strive to improve it whenever and wherever possible in order to increase their opportunity, thereby enhancing their luck in whatever they are doing.

Practically speaking, this Chinese folk culture of Feng Shui could therefore be interpreted as an "art of professional placement" or "opportunity engineering". For the modern Chinese, it is most important for them to seek harmony with Feng Shui, meaning for them to find or identify opportunities for themselves and then to pursue them. The five opportunities most recognized with Feng Shui by the Chinese are 1) Longevity; 2) Luck; 3) Wealth; 4) Health and 5) Fertility. Every Chinese is advised to constantly seek out these opportunities in the hope that they can be realized by executing the right strategies.

Thus, in addition to using a portion of the Mahjongg set to form the Chinese Poker Deck, the incorporation of the concept of Feng Shui into it is equally important and opportunistic in order to blend in the cultural folklore of the Chinese people into this new deck of cards.

However, even if a new deck of cards is created that blends a portion of the Mahjongg set with the concept of Feng Shui, for such a new deck to gain widespread acceptance in both the East as well as the West where the international 52-card pack has gained widespread acceptance, such a deck must be usable in games traditionally played with the international 52-card pack, and the biggest such card game at the present time has to be poker.

Although there are literally hundreds of variations on how poker is played, there are three main categories of popular variations.

First, there is draw poker, in which a certain number of cards are dealt, there is usually a round of betting, and then players still remaining in the game are given the option of drawing one or more additional cards, after which another round of betting ensues. A popular example of draw poker is 5 card draw.

Second, there is stud poker, in which a certain number of cards are dealt one at a time to players, usually with certain cards dealt face up, but the players have no option of discarding cards, and betting rounds ensue in accordance with a preselected set of rules for the game after players have been dealt certain cards (in other words, while a player may fold, if two players stay in to the final card, the outcome of the hand will not change, as it might in draw poker, as a result of a player choice, such as deciding how many and which cards to discard). A popular example of stud poker is 7 card stud poker.

Third, there is community card poker, in which players make a hand from cards dealt to individual players and a number of "community cards" (which are usually dealt face up) that can be used by all players to make a hand in accordance with a preselected set of rules for the game. A popular example of community card poker is Texas Hold 'Em, also known as Hold 'Em or holdem. In Texas Hold 'Em, each player receives two cards face down, and then three community cards are turned face up, followed by a fourth community card turned face up, followed by a fifth and final community card turned face up, with betting rounds ensuing at each stage of the process. Indeed, Texas Hold 'Em has become so popular in the United States today that it is regularly played in tournaments in casinos, card clubs and online websites, and some of the tournaments, such as the World Series of Poker®, are televised events with the winner taking millions of dollars in prize money.

In view of the widespread popularity of poker, and its many variants, it would be extremely desirable if such games could still be played with the Chinese Poker Deck, and it is to this goal that the present invention is directed.

SUMMARY OF THE INVENTION

The present invention is generally directed to a game that is normally played with a traditional deck of cards in accordance with a preselected set of rules for the game that is now played with a Chinese poker deck of 52 cards and the following additional rules: any player with the right to use a first wild card may designate the first card to be any card contained in the Chinese poker deck but no player may use more than one wild card and any player who can not make a hand because the player has more than one wild card looses the hand to any player who can make a hand. The Chinese poker deck has three different sets of nine cards in three suits (e.g., circles, bamboo and script), each of the nine cards in one of the three suits bearing a different designation representing the numbers 1 through 9, five different sets of four cards bearing a unique designation with a hierarchal ranking (e.g., GD, EW, SW, WW and NW, in descending order of ranking, all of which are higher than a 9 for a single card), and a set of five wild cards (e.g, bearing a unique Feng Shui designation).

In a separate group of aspects of the present invention, the game is a poker game (which may be draw poker, stud poker or a community card poker) and, more particularly, a Texas hold 'em game or a variant in which players are either initially dealt four cards or the seventh card is dealt face down to individual players. In addition, a hand with five of a kind is not recognized and looses to a hand with a straight flush.

Accordingly, it is a primary object of the present invention to provide new poker games that play with the same rules as existing poker games with the addition of use of a new deck of cards called the Chinese Poker Deck and certain additional rules related to the differences between a traditional deck of poker cards and the Chinese Poker Deck.

This and further objects and advantages will be apparent to those skilled in the art in connection with the drawings and the detailed description of the preferred embodiment set forth below.

DETAILED DESCRIPTION OF THE INVENTION

In accordance with the present invention, a new deck of cards is disclosed that can be used for a variety of different poker games, some of which are also described herein. The new deck of cards is referred to as the Chinese Poker Deck because, like a traditional poker deck (i.e., a deck of 52 cards, having four suits—clubs, diamonds, hearts and spades—each of which has 13 cards comprised of 2-10 Jack, Queen, King and Ace), it uses 52 cards, but the cards integrate various aspects of traditional Chinese games and culture. The result is a novel deck that allows the East to meet the West, and vice versa.

Figure 1:
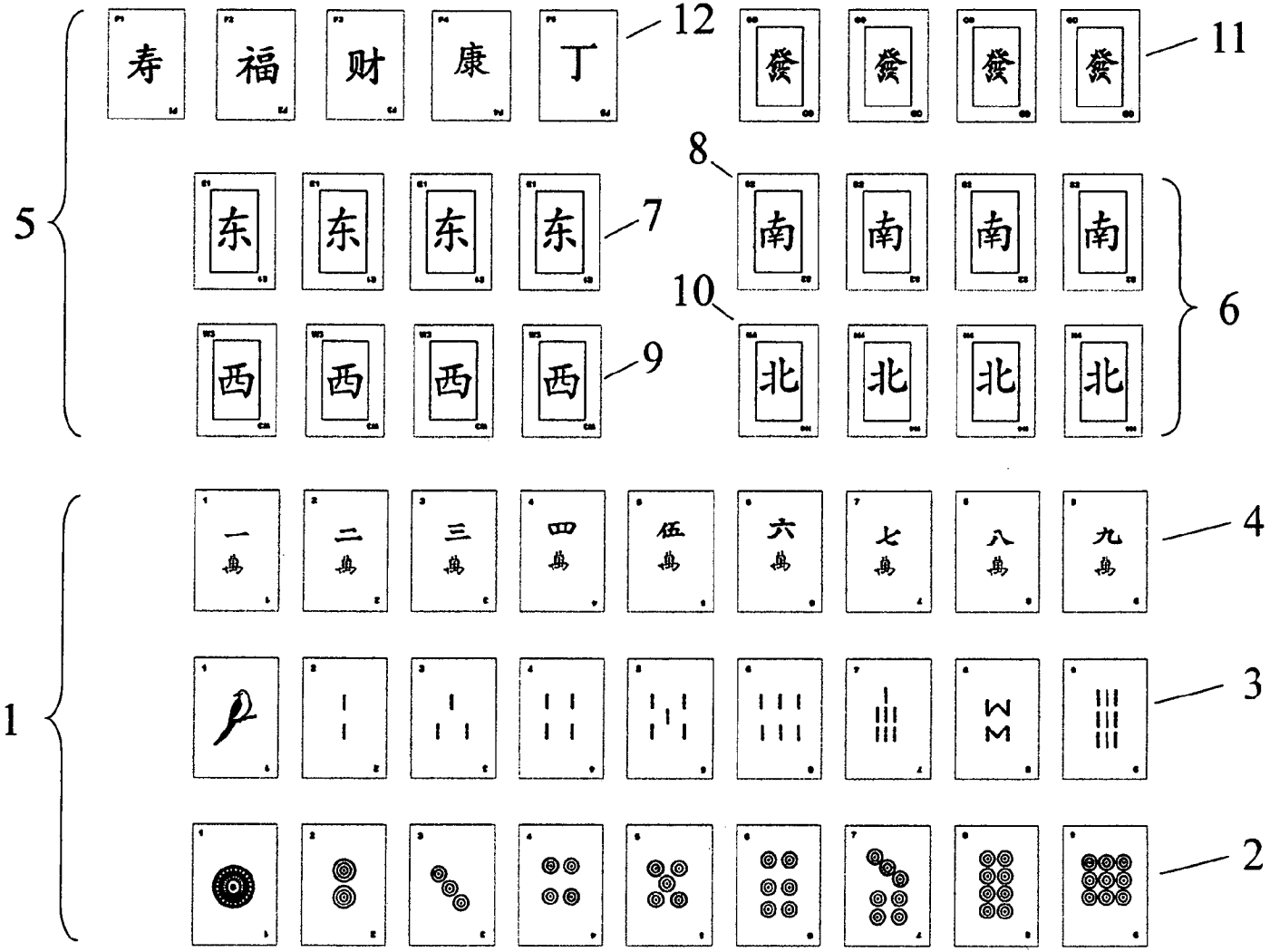
FIG. 1. The currently invented Chinese Poker Deck.

The Chinese Poker Deck is comprised of 27 numbered cards in three suits and 25 additional non-suit cards as shown in FIG. 1. The 27 numbered cards 1 are divided into three groups or suits—circles 2, bamboos 3 and scripts 4—each of which has nine cards numbered from 1 to 9. The 25 additional non-suit cards 5 are divided into 16 wind cards 6 (which is subdivided into four groups representing East 7, South 8, West 9 and North 10 winds, and each wind has four identical cards), 4 Green Dragon cards 11 (each of which is identical) and 5 Feng Shui cards 12. The 5 Feng Shui cards 12 are ranked from 1 to 5, 1 being the highest, and each bears a unique Feng Shui parameter designation which, in an especially preferred embodiment, represents, from 1 to 5, respectively, Longevity, Luck, Wealth, Health and Fertility. The wind and dragon cards might be compared to face cards in a traditional poker deck in that each such card is assigned a value of 10 in games in which the cards need to have a number value, such as in the game of Blackjack, while the five Feng Shui cards are assigned a value of 11 in such games.

The incorporation of the three suits of circles 2, bamboos 3 and scripts 4 into the Chinese Poker Deck ties the deck to the traditional Chinese game of Mahjongg which uses the same three suits. Similarly, Mahjongg also uses the four winds as well as dragons (typically green, red and white). However, unlike Mahjongg, the Chinese Poker Deck uses such symbols and designations in a new context, i.e., the context of a deck of 52 cards. Thus, the Chinese Poker Deck at once invokes a certain feeling of familiarity to one familiar with Mahjongg, while the 52 card deck also invokes a certain feeling of familiarity to one familiar with the traditional poker deck (international 52-card pack).

The Chinese Poker Deck departs from any similarity to Mahjongg by the addition of the five Feng Shui cards 5 (see FIG. 1) which are not found in Mahjongg. Because of the pull of Feng Shui in the Chinese and Eastern culture, even though Feng Shui is not incorporated into Mahjongg, its addition to the Chinese Poker Deck brings an additional type of familiarity to those familiar with its precepts. In addition, because there are 5 such cards, it allows the Chinese Poker Deck to be perfectly rounded out to 52 cards so as to maintain the same number of cards found in the traditional poker deck, which is very desirable for playing poker.

The ramifications of the Chinese Poker Deck are profound. The Chinese Poker Deck can be used to play traditional Western poker games, although the odds and some of the rules (such as values or ordering of hands) will necessarily have to be changed to adapt to the new composition of the deck. While this by itself is interesting, and offers new flavors and variants of games, such could be said for any change to the traditional deck of cards. However, because the Chinese Poker Deck also incorporates ideas found in Mahjongg, it can also be used to play new games that might be analogized as variants of Mahjongg, even though they are totally novel variants in a new medium. And, with the incorporation of the Feng Shui cards, the Chinese Poker Deck opens up totally new possibilities and allows persons familiar with the precepts of Feng Shui to connect with such possibilities on a whole new level. Finally, because all of these variants can be played with the same deck, as one begins playing any of the many games that are possible with the Chinese Poker Deck, one becomes familiar with the new deck, and possibly becomes more open to playing other games with the same deck. In this way, a person familiar with Western games may be drawn to more Eastern types of games, and vice versa, thus creating an intersection of the two cultures in a single deck of cards.

Before one can play traditional poker games with the Chinese Poker Deck, one must reconcile the fact that the 16

Wind cards, 4 Green Dragon cards and 5 Feng Shui cards do not have suits, while there are only three suits with numbers 1 through 9 instead of four suits with numbers 2 through 10. This means that a poker hand of a straight or a flush can only be made with cards from suit values, not from the 16 Wind cards or the 4 Green Dragon cards. In addition, in order to make a pair, three of a kind or four of a kind with Wind or Green Dragon cards, there must be two, three or four of the identical card (i.e., either EW, SW, WW, NW or GD), and two different Wind cards can not be combined to make a pair, three of a kind or four of a kind. Because of these differences, certain additional rules are needed for traditional poker games to still be viable and interesting.

The first rule is that the 5 Feng Shui cards are treated as wild cards, which means that a player with a Feng Shui card can designate the Feng Shui card to be any card contained in the Chinese Poker Deck. The result of this rule is that it is now possible to make a straight, a flush, or a straight flush using four numbered cards of appropriate suits plus a Feng Shui card. However, because of the inherent value of a such a wild card, many poker games would no longer be interesting without another rule to counter the effect of such wild cards, and the second rule that provides such counterbalance is that a player can only use one Feng Shui card in a given hand and, if as a result of this rule a player can not make a hand, then the player loses to any other player who can make a hand. Thus, for example, if a first player is playing five card draw and has a GD, a NW, a SW, a 9 of bamboo and a Feng Shui card while a second player has two EW, a SW, a WW and a NW, the first player has the highest hand prior to the draw, because the first player has a pair of GD while the second player only has a pair of EW, which is lower in ranking than a pair of GD. Now, in this same example, if the first player decides to discard the NW, SW and 9 of bamboo and draws two additional GD cards plus one more Feng Shui card, the first player will automatically lose the hand (even though the first player has 4 GD cards) unless the second player draws two or more Feng Shui cards because the first player can not use the second Feng Shui card to make a hand. (If both players cannot make a hand, the particular hand is a draw.)

Figure 2:
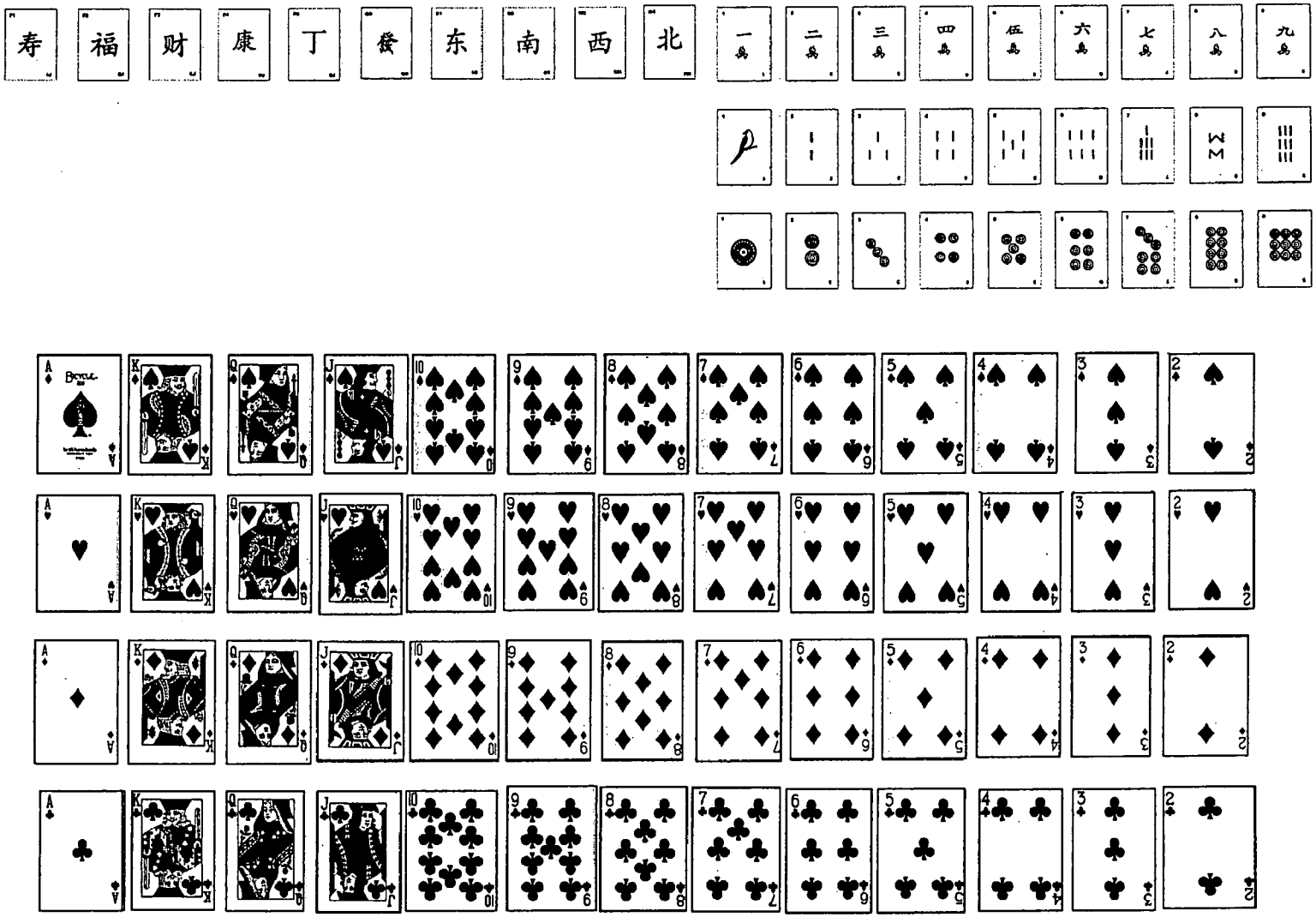
FIG. 2. The ranking of the cards in both the traditional poker deck and the presently invented Chinese Poker Deck.
Figure 3:
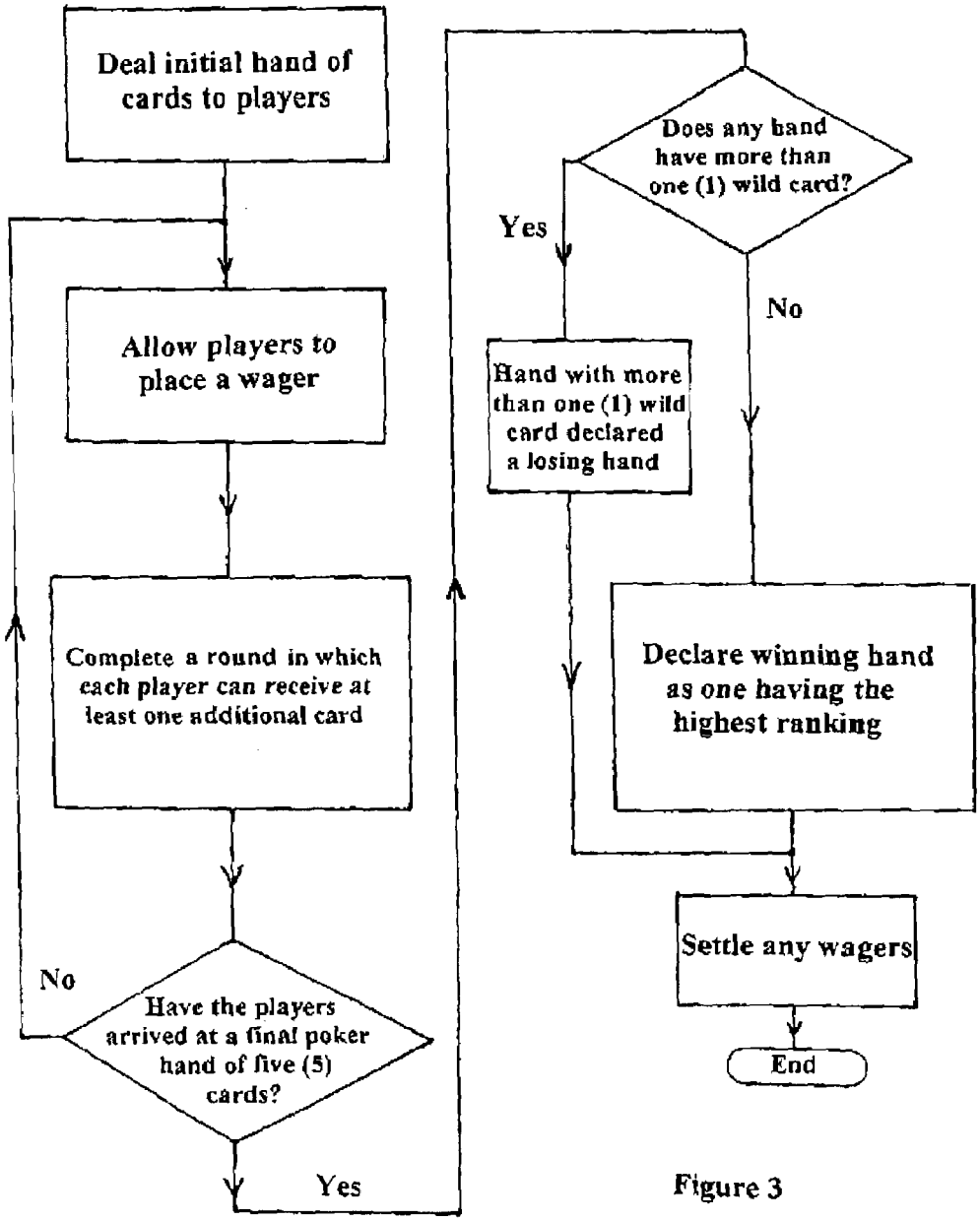
FIG. 3. A flow chart showing a method of playing a poker game according to the present invention.

Thus, although Feng Shui cards are wild, which is a very good thing, too much of a good thing can be very bad for a hand, and this is what gives hope to a player who does not have a Feng Shui card, and also tempers the enthusiasm of a player who does have a Feng Shui card. It is the key rules involving the 5 Feng Shui cards that makes poker games with the Chinese Poker Deck viable and exciting while still keeping the same rules and traditional poker rankings (the lowest ranking being the highest one of a kind, followed by one pair, followed by two pairs, followed by three of a kind, followed by a straight, followed by a flush, followed by a full house, followed by four of a kind, followed by a straight flush—see FIG. 2) that are already familiar to tens of millions of poker players. However, in order to keep the same traditional poker rankings in place, one must also recognize that a wild card introduces the possibility of a hand not found in traditional poker games that do not use wild cards—the possibility of a hand of five of a kind. To maintain traditional rankings, and thus eliminate confusion that might result from recognizing such a hand, another specialized rule for playing traditional poker games with the Chinese Poker Deck is that a hand of five of a kind is not recognized. (Of course, if one wants to play a poker game in which the variant recognizes wild cards, then this rule might not apply, although it would be desirable to specify how such a hand would be ranked vis-à-vis a straight flush to avoid inevitable disputes over such a matter.)

To further illustrate the present invention, a new poker game, called by the trademark name YANGTZE HOLD 'EM, will now be described. Yangtze™ Hold-em is a community card poker game that is played with the 52-card Chinese Poker Deck (which is being marketed under the trademark Dragon Deck™). The game starts to the left of the dealer button. The blind bet(s) are made from the position(s) left of the dealer button and are forced bets which must be made before the cards are dealt. Two cards (hole cards) are dealt to each player, one at a time, face down, in rotation. This is followed by the first round of betting. A player may check, bet, call, raise or fold. Three cards (the flop) are then dealt face up in the middle of the table as community cards (board cards) and the second round of betting occurs. The fourth community card is dealt face up (the turn), followed by the third round of betting. The final community card (the river) is dealt face up and followed by the fourth (final) round of betting. At the showdown, each player may use any combination of the hole cards and community cards, or may play the board and use no hole cards to make the highest ranking five-card poker hand. The player with the highest ranking five-card poker hand wins the pot. In the event of a tie, the pot is split equally. A player may only use one wild card to make a five-card poker hand and five-of-a-kind is not recognized as a poker hand. If a player cannot make a five-card poker hand and another player can, the player who cannot make a five-card poker hand loses.

From the description of the invention already set forth, it should be readily apparent that any poker game presently being played with the familiar international 52-card pack in accordance with a preselected set of rules for the game can also be played with the Chinese Poker Deck described herein with the addition of the specific rules associated with its use which also have already been described herein.

While the invention has been described herein with reference to certain embodiments, those embodiments have been presented by way of example only, and not to limit the scope of the invention. Additional embodiments thereof will be obvious to those skilled in the art having the benefit of this detailed description. Further modifications are also possible in alternative embodiments without departing from the inventive concept. For example, just like there are many variants on the game of poker, there can be many variants to the play, rules and characteristics of the games set forth in this disclosure, and many more games can be invented and played with the Chinese Poker Deck. In this regard, there are many variants of poker games that use wild cards, or add another card to the deck (which is usually a Joker treated as a wild card), and the same games can be played with the Chinese Poker Deck, either requiring the new wild cards to be subject to the rule that only one wild card can be used to make a hand, or not, depending upon what type of game is desired. In addition, while it is considered especially desirable that a Chinese Poker Deck be used that includes a portion of the Mahjongg set and incorporates concepts of Feng Shui, it is readily apparent that, once poker games using the concepts of the Chinese Poker Deck catch on, alternative decks might be designed that have the same playing characteristics without symbols adopted from the Mahjongg set or Feng Shui.

Accordingly, it will be apparent to those skilled in the art that still further changes and modifications in the actual concepts described herein can readily be made without departing from the spirit and scope of the disclosed inventions as defined by the following claims.

What is claimed is:

1. A method of playing a poker game using at least one deck of 52 playing cards wherein at least two playing hands are given a chance to make a poker hand of five cards, the method comprising the steps of:

dealing an initial hand of cards to the at least two playing hands from a deck of 52 playing cards comprised of a first group of suited cards, a second group of non-suited cards and a third group of wild cards;

granting the at least two playing hands a chance to place a wager;

completing at least one round in which each of the at least two playing hands can receive at least one additional card until each of the at least two playing hands arrives at a final poker hand of five cards;

determining whether any of the at least two playing hands has more than one wild card and, if it does, declaring any such hand a losing hand;

declaring a winning hand to be the hand having a highest ranking that is not a losing hand; and settling any wagers.

2. The method of claim 1, wherein the at least two playing hands are first dealt two non-community cards and then at least one community card is dealt face up for use by all of the at least two playing hands.

3. The method of claim 1, wherein the at least two playing hands are first dealt five cards and then each of the at least two playing hands is allowed to choose to discard up to x cards that are then replaced by x new draw cards.

4. The method of claim 1, wherein the at least two playing hands are dealt at least one card face down and at least one card face up.

5. The method of claim 1, wherein the third group of wild cards is comprised of five wild cards.

6. The method of claim 5, wherein the first group of suited cards is comprised of three suits, each of which has one of nine identical number designations, the nine number designations forming a sequential order.

7. The method of claim 6, wherein the second group of non-suited cards is comprised of five sets of four identical non-suited cards, each of the five sets having its own unique designation.

8. The method of claim 5, wherein each of the five wild cards has a unique feng shui designation.

9. The method of claim 8, wherein the nine identical number designations are 1, 2, 3, 4, 5, 6, 7, 8, and 9 and the three suits are comprised of a circle designation, a bamboo designation and a script designation and wherein four of the unique designations of the five sets of four identical non-suited cards are an East Wind designation, a South Wind designation, a West Wind designation and a North Wind designation.

10. The method of claim 7, wherein the highest ranking is determined based upon a poker ranking of hands, from highest to lowest, as follows:

a straight flush hand of five number designations from the first group of suited cards in a consecutive sequence;

a four of a kind hand;

a full house hand comprised of a three of a kind and two of a kind;

a flush hand comprised of five number designations from the first group of suited cards in a single suit in a non-consecutive sequence;

a straight hand comprised of five number designations from the first group of suited cards in more than a single suit in a consecutive sequence;

a three of a kind hand;

a two pair hand comprised of a pair of two of a kind;

a pair hand comprised of a single pair of two of a kind; and a high card hand comprised of none of the above hands;

wherein any of the four of a kind, three of a kind and two of a kind are made by having an x number of identical non-suited cards or x cards with identical number designations from the first group of suit cards, the x being the number of a kind; and wherein one wild card can be designated to represent any card in either the first group of suited cards or the second group of non-suited cards.

11. A method of playing a card game using at least one deck of 52 playing cards, comprising the steps of:

dealing an initial hand of cards to at least two playing hands from a deck of 52 playing cards comprised of a first group of suited cards, a second group of non-suited cards and a third group of wild cards;

granting at least one of the at least two playing hands a chance to place a wager;

completing at least one round in which at least one of the at least two playing hands can receive at least one additional card until each of the at least two playing hands has a final hand of cards;

determining whether any of the at least two playing hands has more than one wild card in its final hand of cards and, if it does, declaring any such hand a losing hand;

declaring a winning hand to be the hand having a highest ranking that is not a losing hand; and settling any wagers.

12. The method of claim 11, wherein the third group of wild cards is comprised of five wild cards.

13. The method of claim 12, wherein the first group of suited cards is comprised of three suits, each of which has one of nine identical number designations.

14. The method of claim 13, wherein the second group of non-suited cards is comprised of five sets of four identical non-suited cards, each of the five sets having its own unique designation.

15. The method of claim 14, wherein each of the five wild cards has a unique feng shui designation.

16. The method of claim 15, wherein the nine identical number designations are 1, 2, 3, 4, 5, 6, 7, 8, and 9 and the three suits are comprised of a circle designation, a bamboo designation and a script designation and wherein four of the unique designations of the five sets of four identical non-suited cards are an East Wind designation, a South Wind designation, a West Wind designation and a North Wind designation.

* * * * *